US006205316B1

(12) United States Patent
Iida

(10) Patent No.: US 6,205,316 B1
(45) Date of Patent: Mar. 20, 2001

(54) FIXING APPARATUS

(75) Inventor: Yujiro Iida, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 09/442,689

(22) Filed: Nov. 18, 1999

(30) Foreign Application Priority Data

Nov. 20, 1998 (JP) ..... 10-331504

(51) Int. Cl.[7] ..... G03G 15/20
(52) U.S. Cl. ..... 399/323; 271/307; 399/398
(58) Field of Search ..... 399/323, 398, 399/322, 399; 271/307, 308, 311

(56) References Cited

U.S. PATENT DOCUMENTS 4,475,804 * 10/1984 Kanno et al. ..... 399/323
4,929,983 * 5/1990 Barton et al. ..... 399/323
5,151,742 * 9/1992 Yamaguchi ..... 399/323
5,517,292 * 5/1996 Yajima et al. ..... 399/323
5,608,512 * 3/1997 Endo ..... 399/323
5,671,471 * 9/1997 Mizuno et al. ..... 399/297

FOREIGN PATENT DOCUMENTS 1-060553 * 3/1989 (JP) .
8-137322 * 5/1996 (JP) .

* cited by examiner

*Primary Examiner*—Sophia S. Chen
(74) *Attorney, Agent, or Firm*—Akin, Gump, Strauss, Hauer & Feld, L.L.P.

(57) ABSTRACT

A fixing apparatus has a heat roller, a paper-separating lug, and a guide roller. The lug engages the heat roller to separate a recording medium from the heat roller if the recording medium rotates in contact with the heat roller. The lug is movable between a first position and a second position. The lug is brought into contact engagement with the heat roller when the lug is in the first position and out of contact engagement with the heat roller in the second position. The guide roller is rotatably mounted to the lug. The guide roller extends into a plane in which a travel path of the recording medium lies, and guides the recording medium after the recording medium is separated from the heat roller.

5 Claims, 14 Drawing Sheets

FIXING APPARATUS

BACKGROUND OF THE INVENTION

1. Field of the Invention

The present invention relates to a fixing unit and more particularly to a paper-separating mechanism for use in the fixing unit.

2. Description of the Related Art

With a conventional electrophotographic printer, a charging roller charges the surface of a photoconductive drum and an exposing unit such as an LED head writes an electrostatic latent image on the charged surface of the photoconductive drum. The electrostatic latent image is then developed with toner into a visible image, i.e., toner image. The toner image is subsequently transferred to a print medium when the print medium passes in a sandwiched relation between the photoconductive drum and a transfer roller.

FIG. 19 is a cross-sectional view of a conventional art fixing apparatus.

FIG. 20 is a top view illustrating a relevant portion of the conventional art paper-separating apparatus for use in the fixing apparatus.

Referring to FIG. 19, a fixing section 11 includes a heat roller 12 and a pressure roller 13. The heat roller 12 is rotatably supported and incorporates a halogen lamp 12*a* that functions as a heat-generating element. The pressure roller 13 is urged by urging means such as a spring, not shown, against the heat roller 12. The heat roller 12 and pressure roller 13 are accommodated in a casing 14. A paper-separating mechanism 80 is attached to the casing 14. The paper-separating mechanism 80 is rotatable with respect to the casing and separates recording paper from the heat roller 12 when the recording paper 15 has intimately wrapped around the heat roller 12 during the fixing operation.

The paper-separating mechanism 80 includes a substantially triangular lug 16 rotatably mounted on a shaft 81 and a guide roller 17 rotatably mounted on the lug 16. The guide roller 17 rotates freely on a shaft 83 and guides the recording paper 15 downstream therefrom. The lug 16 is urged by a compression spring 18 to rotate in a direction opposite to the direction shown by arrow B so that a tip 82 of the lug 16 is pressed against the heat roller 12. A paper-discharging mechanism 22 is provided downstream of the fixing section 11. The paper-discharging mechanism 22 includes a transport roller 19 and a pinch roller 20. The transport roller 19 is driven in rotation by a drive source, not shown. The pinch roller 20 is urged by a flat spring 21 against the transport roller 19, and rotates together with the transport roller 19.

The operation of the fixing apparatus of aforementioned construction will be described.

A toner image formed on the photoconductive drum, not shown, is transferred to the recording paper 15 by the transfer device. Then, as the photoconductive drum rotates, the recording paper having the toner image thereon is advanced substantially horizontally in a direction shown by arrow A. The recording paper 15 reaches the fixing section 11 and is pulled in between the heat roller 12 and pressure roller 13, so that the recording paper 15 is heated pressurized. As a result, the toner image is fixed and the printing completes.

As the heat roller 12 and pressure roller 13 rotate, the recording paper 15 having an image printed thereon is further advanced to the discharging section 22 where the recording paper is pulled in between the transport roller 19 and pinch roller 20 and discharged outside of the printer.

The operation of the paper-separating mechanism 80 will be described.

Prior to the arrival of the recording paper 15, the lug 16 is positioned at the dotted line position as shown in FIG. 19, i.e., a standby position where the lug 16 is in contact with the heat roller 12. When the leading end of the recording paper 15 comes into contact with the corner 16*a* of the lug 16, the recording paper 15 pushes the lug 16 up in a direction shown by arrow B against the urging force of the spring 18. As a result, the lug 16 moves to the solid line position of FIG. 19 where the tip 82 of the lug 16 is away from the heat roller 12. When the stopper 16*b* of the lug 16 abuts the casing 14 (i.e., solid line position), the stopper prevents further rotation of the lug 16 and the distance between the heat roller 12 and the tip 82 of the lug 16 reaches a maximum t.

Then, the transport roller 19 and pinch roller 20 advance the recording paper 15. When the trailing end of the recording paper 15 passes the corner 16*a*, the lug 16 returns to the dotted line position of FIG. 19 whether the lug 16 is in its standby state.

With the aforementioned conventional fixing apparatus, the corner 16*a* of the paper-separating lug 16 extends into a plane where the paper path lies. Therefore, when the recording paper 15 is advanced, part of the printed surface of the recording paper 15 rubs the corner 16*a*. When a solid black image is printed on the recording paper 15, the gloss of the image areas that rub the corner 16*a* is significantly different from that of the image areas that do not rub the corner 16*a*. This impairs the image quality.

SUMMARY OF THE INVENTION

An object of the invention is to solve the aforementioned drawbacks of the conventional fixing apparatus and to provide a fixing apparatus that improves the image quality.

A fixing apparatus comprises a heat roller, paper-separating lug, and guide roller. The lug engages the heat roller to separate a recording medium from the heat roller if the recording medium wraps around the roller. The lug is movable between a first position and a second position. The lug is brought into contact engagement with the roller when the lug is in the first position and being out contact engagement with the roller. The guide roller is rotatably mounted to the lug. The guide roller extends into a plane in which a travel path of the recording medium lies, and guides the recording medium after the recording medium is separated from the heat roller.

The lug is rotatable within a predetermined angular range relative to the heat roller so that the lug is away from the heat roller by a predetermined maximum distance when the lug is in the second position.

The guide roller may be movable relative to the lug so that the guide roller extend into and retract from the plane in which the travel path of the recording medium lies. The guide roller yieldably retracts from the plane when the recording medium pushes the guide roller out of the way.

The fixing apparatus may further comprise a holder that holds the lug such that the lug is rotatable relative to the holder. The lug may have a tip and is freely rotatable such that the tip is movable over the predetermined distance when the lug is in the second position. The lug rotates such that the tip moves into contact engagement with the roller when the recording paper pushes the lug.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus do not necessarily limit the scope of the present invention, and wherein.

DETAILED DESCRIPTION OF THE INVENTION

Preferred embodiments of the present invention will be described in detail with reference to the accompanying drawings.

First Embodiment

<Construction>

Figure 1:
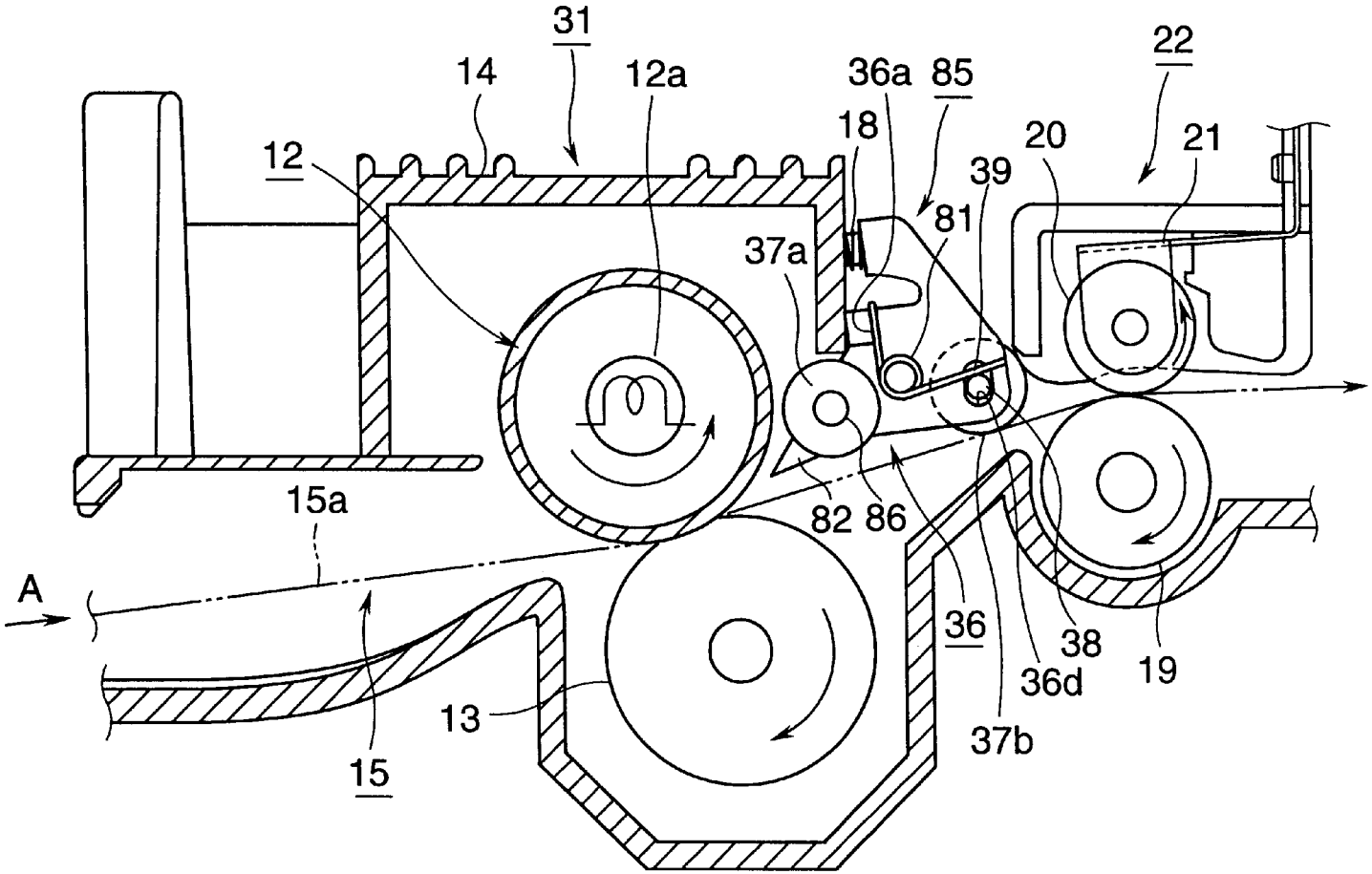
FIG. 1 is a cross-sectional view of a fixing apparatus according to a first embodiment of the invention.

FIG. 1 is a cross-sectional view of a fixing apparatus according to a first embodiment of the invention.

Figure 2:
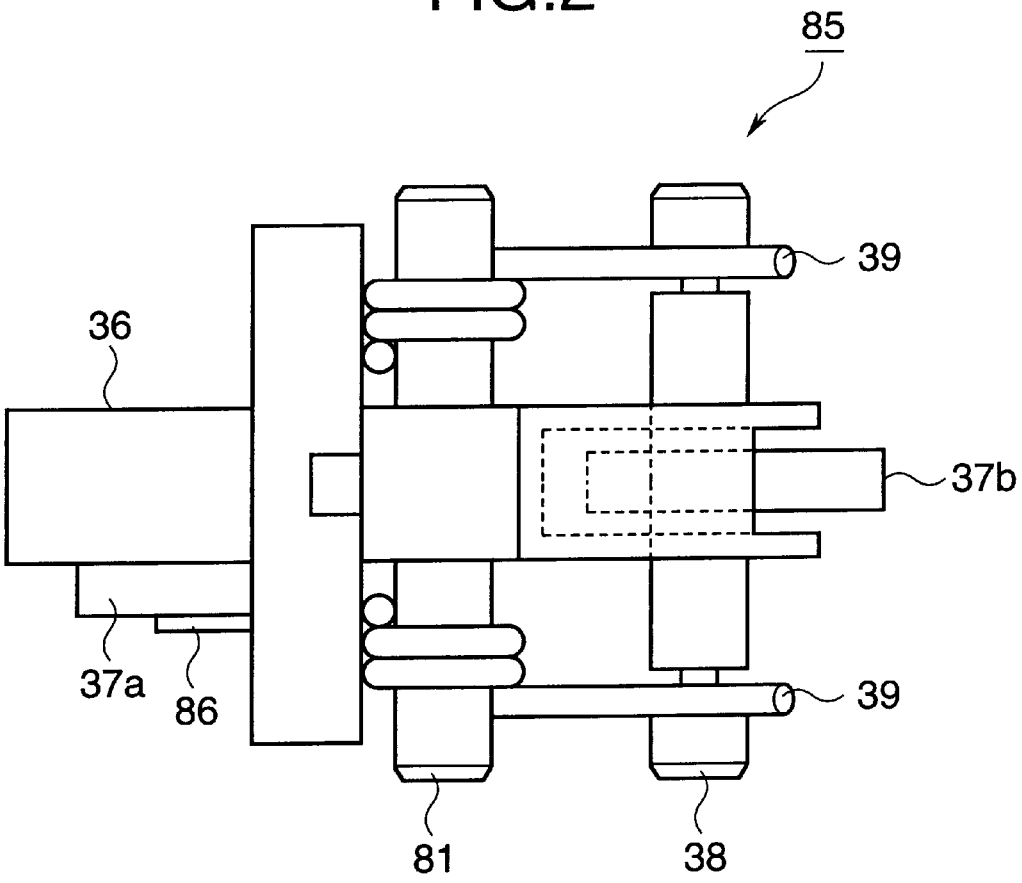
FIG. 2 is a top view of a paper-separating mechanism, illustrating a relevant portion.

FIG. 2 is a top view of a paper-separating mechanism, illustrating a relevant portion.

Figure 3A:
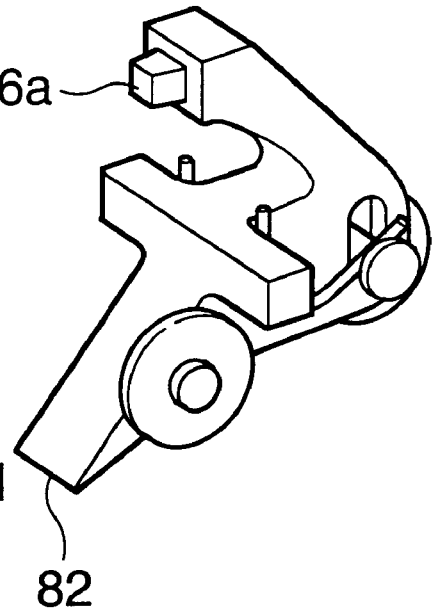
FIGS. 3A–3B are perspective views of the paper-separating mechanism of FIG. 2.
Figure 3B:
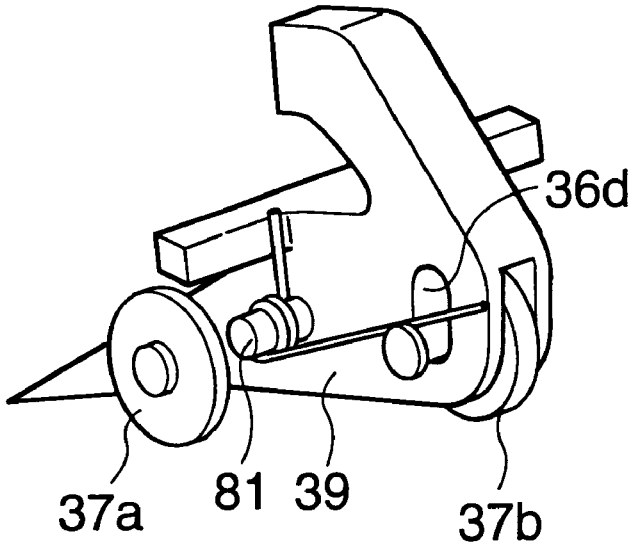

FIGS. 3A–3B are perspective views of the paper-separating mechanism of FIG. 2.

Referring to FIGS. 1 and 2, a fixing section 31 incorporates a heat roller 12, a pressure roller 13, a casing 14, and a paper-separating mechanism 85. The heat roller 12 is rotatable and incorporates a halogen lamp 12*a* therein as a heat source. The pressure roller 13 is disposed under the heat roller 12 and is urged by an urging member such as a spring, not shown, against the heat roller 12. The casing 4 houses the heat roller 12 and the pressure roller 13 therein. There are provided a plurality of paper-separating mechanisms 85 at predetermined intervals along the length of the heat roller 12. The paper-separating mechanisms 85 are fixedly mounted on projecting portions of the casing 14, not shown. The paper-separating mechanism 85 operates to separate the recording paper 15 as a recording medium from the heat roller 12 when the recording paper 15 is wrapped around the heat roller 12.

The paper-separating mechanism 85 includes a paper-separating lug 36; an upstream guide roller 37*a* and a downstream guide roller 37*b*, a spring 18, and a spring 39. The first and downstream guide rollers 37*a* and 37*b* guide the recording paper 15 toward a discharge section 22 downstream of the fixing section 31. The spring 18 urges a tip 82 of the lug 36 against the heat roller 12. The spring 39 urges the downstream guide roller 37*b* downward.

The lug 36 is rotatably mounted on a shaft 81 so that the tip 82 may be caused to move into and out of contact engagement with the heat roller 12. The upstream guide roller 37*a* is mounted on the lug 36 and is allowed to freely rotate on a shaft 86. The downstream guide roller 37*b* is secured to a shaft 38 that extends through an elongated hole 36*d* formed in the lug 36. Thus, the downstream guide roller 37*b* is movable along the elongated hole 36*d*. The shaft 81 extends through the spring 39. One end of the spring 39 engages an engagement portion 36*a* of the lug 36 and the other end of the spring 39 engages the shaft 38 of the downstream guide roller 37*b*. The upstream guide roller 37*a* is located upstream of the downstream guide roller 37*b* with respect to the direction of travel of the recording paper 15.

The discharging section 22 is located downstream of the fixing section 31. The discharging section 22 includes a transport roller 19, a pinch roller 20, and a flat spring 21. The transport roller 19 is rotatably supported. The pinch roller 20 is above the transport roller 19 and is urged by the flat spring 21 against the transport roller 19.

<Operation>

The operation of the aforementioned fixing apparatus will be described.

A toner image formed on the photoconductive drum, not shown, is transferred to the recording paper 15 by a transfer device, not shown. Then, as the photoconductive drum rotates, the recording paper 15 is advanced in a direction shown by arrow A to the fixing section 31. The heat roller 12 and the pressure roller 13 rotate in directions shown by arrows, respectively. The recording paper 15 is pulled in between the heat roller 12 and the pressure roller 13, thereby being heated and pressurized so that the toner image is fixed on the recording paper 15. In this manner, the printing completes.

The heat roller 12 and pressure roller 13 further advances the recording paper 15 to the discharging section 22. The recording paper 15 is sandwiched between the transport roller 19 and the pinch roller 20, and is then advanced toward the paper exit as the transport roller 19 and pinch roller 20 rotate. Reference 15*a* denotes a travel path of the recording paper 15.

The operation of the paper-separating mechanism 85 will be described.

Figure 4:
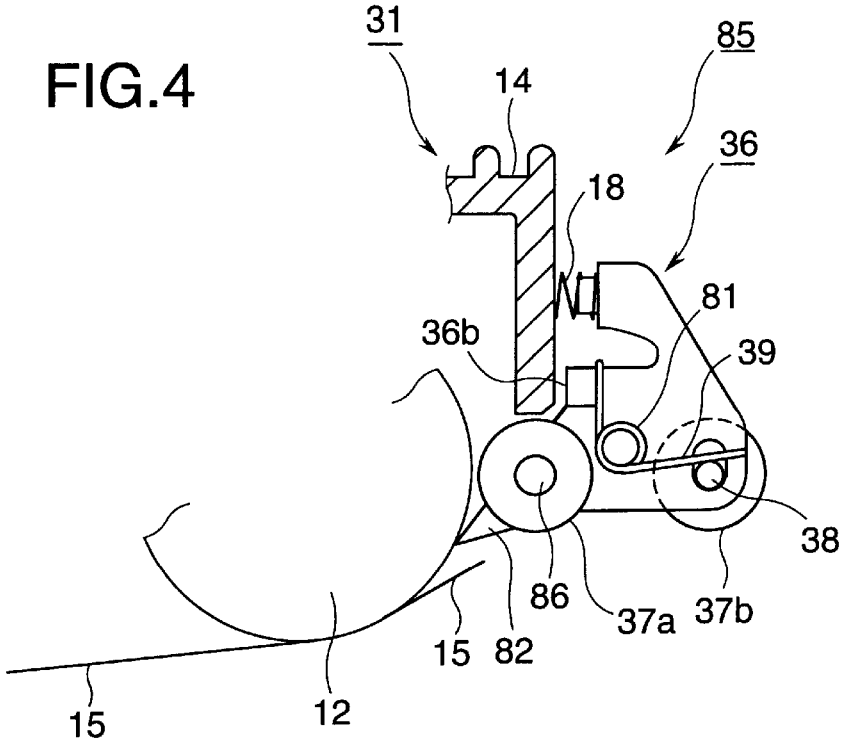
FIG. 4 illustrates the paper-separating mechanism when it is in the standby state or a first position.

FIG. 4 illustrates the paper-separating mechanism 85 when it is in the standby state or a first position.

Referring to FIG. 4, the leading end of the recording paper 15 is not in contact with the heat roller 12. The tip 82 of the lug 36 is in contact with the heat roller 12.

Figure 5:
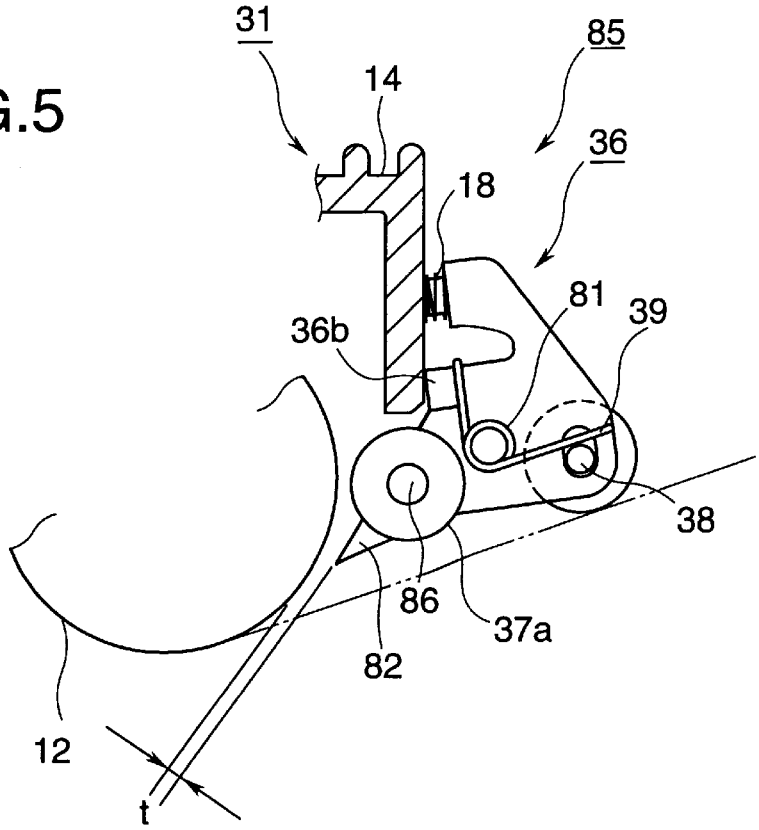
FIG. 5 illustrates the paper-separating mechanism when the tip 82 is out of engagement with the heat roller.

FIG. 5 illustrates the paper-separating mechanism 85 when the tip 82 is out of engagement with the heat roller 12 or at a second position.

Referring to FIG. 5, when the leading end of the recording paper 15 comes into contact with the downstream guide roller 37*b*, the leading end of the recording paper 15 pushes the downstream guide roller 37*b*. The lug 36 yieldably rotates about the shaft 81 in a direction shown by arrow B overcoming the urging force of the spring 18. The tip 82 of the lug 16 moves out of engagement with the heat roller 12. The lug 36 can rotate through a predetermined angle till a stopper 36*b* of the lug 36 abuts the casing 14 so that the lug 36 is prevented from rotating any further and the tip 82 is away from the casing 14 by a maximum distance t.

Subsequently, the transport roller 19 and the pinch roller 20 advance the recording paper 15 toward the paper exit. When the trailing end of the recording paper 15 has passed the downstream guide roller 37*b*, the lug 36 returns to the position as shown in FIG. 4.

Figure 6:
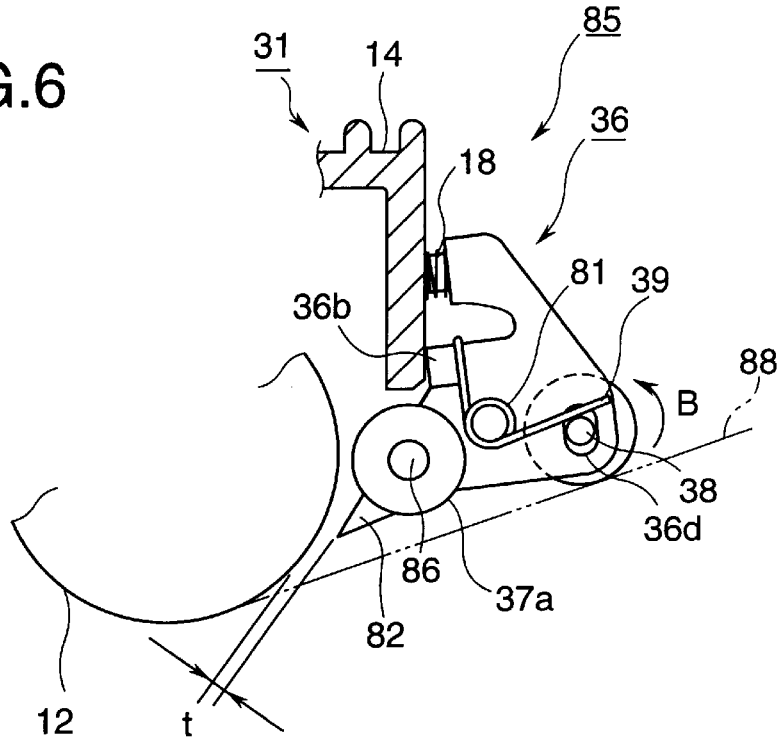
FIG. 6 illustrates the operation of the paper-separating mechanism 85 when thick, stiffer recording paper is fed.

FIG. 6 illustrates the operation of the paper-separating mechanism 85 when thicker, stiffer recording paper 88 is fed.

When the leading end of the recording paper 15 pushes up the guide roller 37*b*, the lug 36 is at the position shown in FIG. 5 where the stopper 36*b* abuts the casing 14 and the distance between the tip 82 and the casing 14 is a maximum t. The recording paper 88 further pushes the guide roller 37*b* up so that the shaft 38 is yieldably moved upward along the elongated hole 36*d*.

Therefore, even when the recording paper 88 travels in contact with the guide roller 37*b* and pushes up the guide roller 37*b* strongly, the printed surface of the recording paper 88 will not be rubbed by the guide roller 37*b* at all. Thus, when a solid black printing is performed, the gloss of the image areas that come into contact with the second guide roller 36*d* is substantially the same as that of the image areas that do not come into contact with the second guide roller 37*b*. This improves the quality of printed images.

The distance between the tip 82 and the heat roller 12 when a printing is performed on stiff recording paper is the same as that when a printing is performed on softer recording paper. Moreover, the second guide roller 37*b* is yieldably pushed up by the recording paper 88, therefore, there is less chance of the recording paper 88 of being damaged.

Second embodiment

<Construction>

Figure 7:
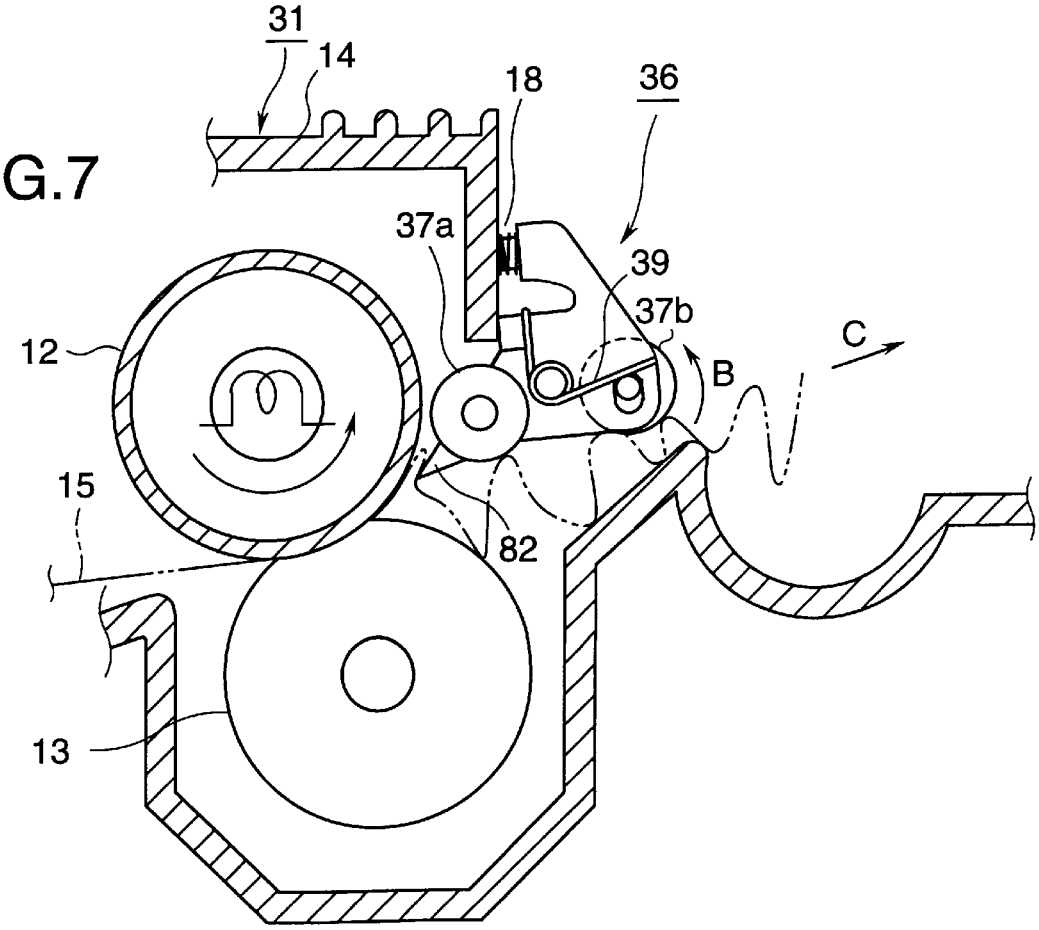
FIG. 7 illustrates paper jam that occurs in the fixing section.

FIG. 7 illustrates an example of paper jam that occurs in the fixing section 31 of the first embodiment.

In the first embodiment, if the recording paper 15 is deformed into a bellow-like shape while it is travelling through the fixing section, a paper jam occurs. Then, recording paper 15 pushes up the downstream guide roller 37*b*, so that the lug 36 rotates in the direction shown by arrow B against the urging force of the spring 18 while the tip 82 remains out of contact engagement with the heat roller 12.

Then, the recording paper 15 may be caught between the tip 82 and the heat roller 12. If a user pulls the recording paper 15 in a direction shown by arrow C in an attempt to remove the jammed paper, the recording paper 15 is hooked by the tip 82 and torn. As a result, small pieces of the paper can be left between the tip 82 and the heat roller 12.

A second embodiment prevents the recording paper 15 from being caught between the tip 82 and the heat roller 12.

Figure 8:
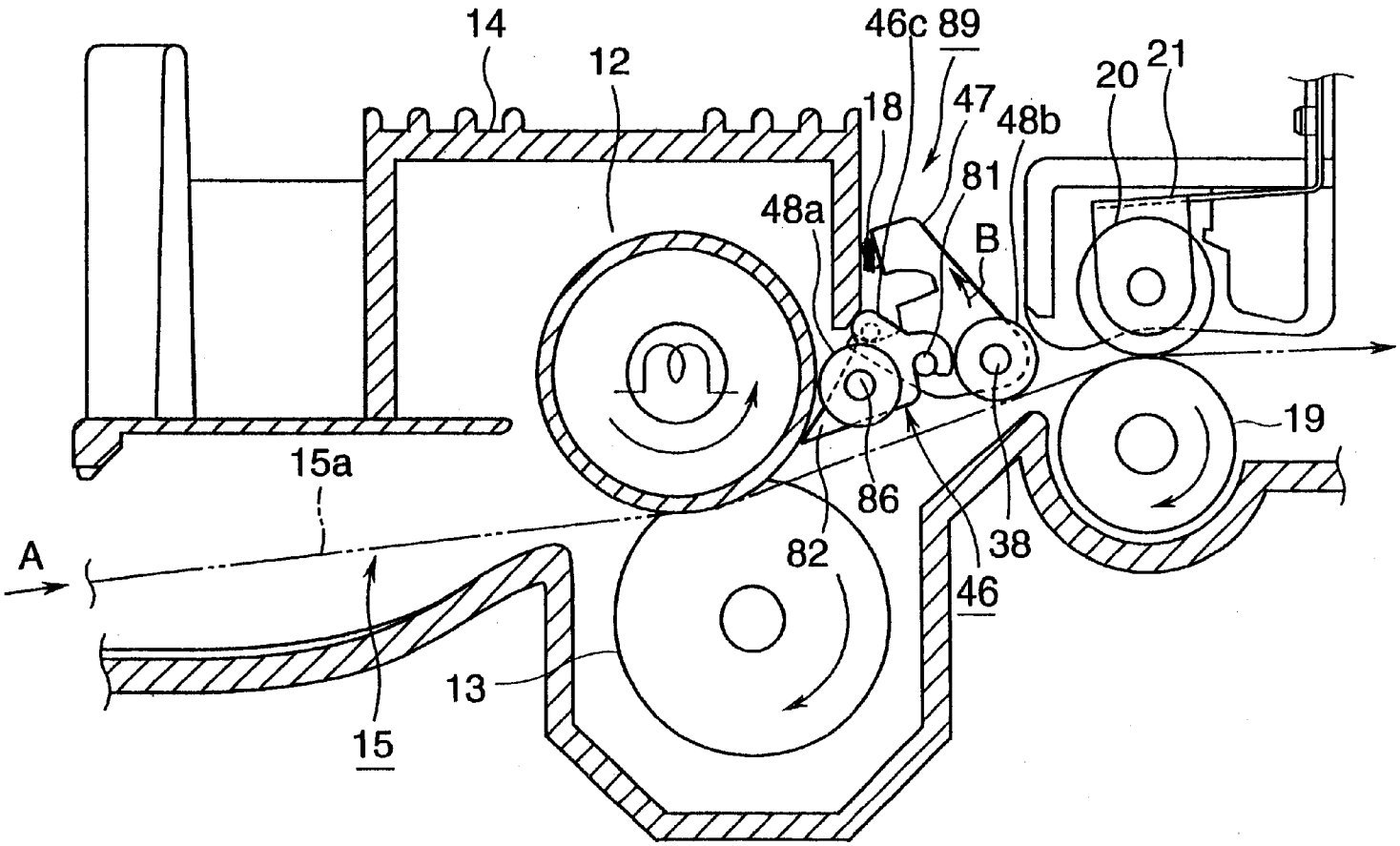
FIG. 8 is a cross-sectional view of a fixing apparatus according to a second embodiment.

FIG. 8 is a cross-sectional view of a fixing apparatus according to the second embodiment.

Figure 9:
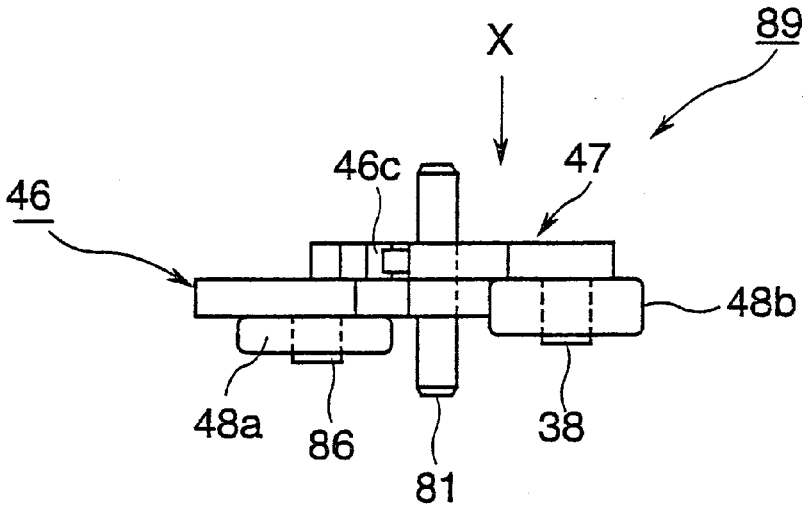
FIG. 9 is a top view of a paper-separating mechanism of the second embodiment.

FIG. 9 is a top view of a paper-separating mechanism of the second embodiment.

Figure 10:
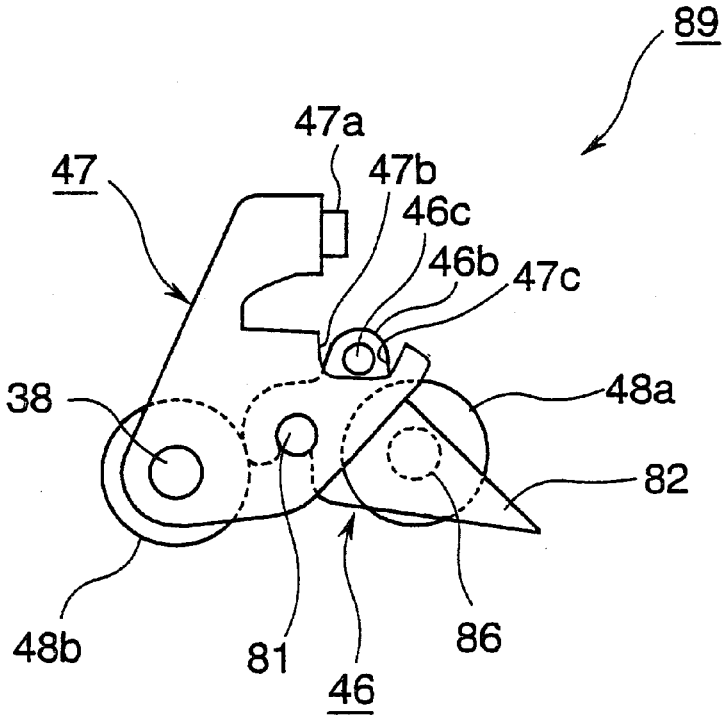
FIG. 10 is a rear view of the paper-separating mechanism according to the second embodiment as seen in a direction shown by arrow X of FIG. 9.

FIG. 10 is a rear view of the paper-separating mechanism as seen in a direction shown by arrow X of FIG. 9.

There are provided a plurality of paper-separating mechanisms 89 at predetermined intervals along the length of the heat roller 12. The paper-separating mechanisms are fixedly mounted on projecting portions of the casing 14, not shown.

The paper-separating mechanism 89 includes a paper-separating lug 46, a holder 47, upstream and downstream guide rollers 48*a* and 48*b*, and a compression spring 18.

The holder 47 is rotatably supported on a part of the casing 14 and is rotatable on the shaft 81. The holder 47 is formed with a projection 47*a* over which the spring 18 fits. The spring 18 urges the holder 47 to rotate in a direction opposite to the direction shown by arrow B (FIG. 8) such that the downstream guide roller 48*b* extends into the plane in which a travel path of the recording paper 15 lies and the tip 82 is pressed against the heat roller 12. The holder 47 is formed with stoppers 47*b* and 47*c* therein. The lug 46 is generally triangular in shape and is rotatably supported on the holder 47.

The lug 46 can freely rotate about the shaft 81 but is limited its rotation when a pin 46*c* abuts the stoppers 47*b* and 47*c* as in FIG. 10. If no external force is applied by, for example, recording paper 15, the lug 46 rotates due to the weight of the lug 46 till the pin 46*c* abuts the stopper 47*c*.

The downstream guide roller 48*b* is supported on the shaft 38 and the upstream guide roller 48*a* is supported on a shaft 86. Both the upstream and downstream guide rollers 48*a* and 48*b* are freely rotatable, and guide the recording paper 15 toward the discharging section (rightward in FIG. 8) after the recording paper 15 is separated from the heat roller 12.

<Operation>

The operation of the paper-separating mechanism 89 of the aforementioned construction will be described.

Figure 11:
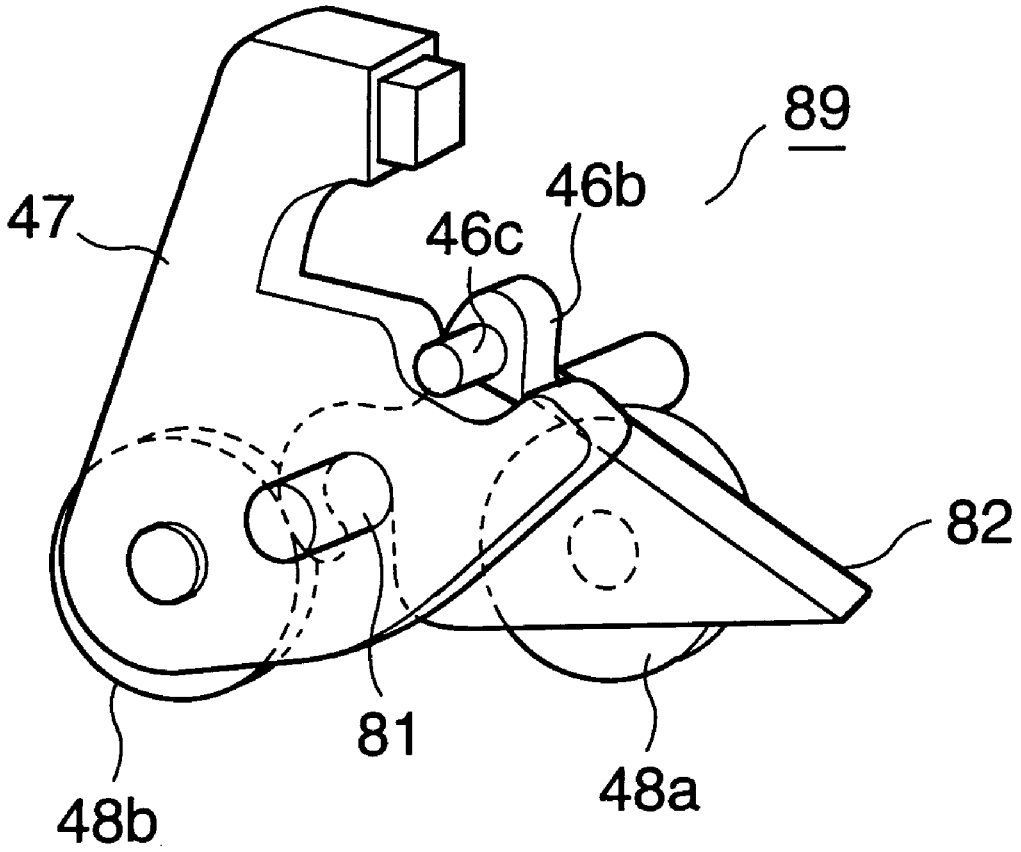
FIG. 11 is a perspective view of the paper-separating mechanism according to the second embodiment.

FIG. 11 is a perspective view of the paper-separating mechanism 89.

Figure 12:
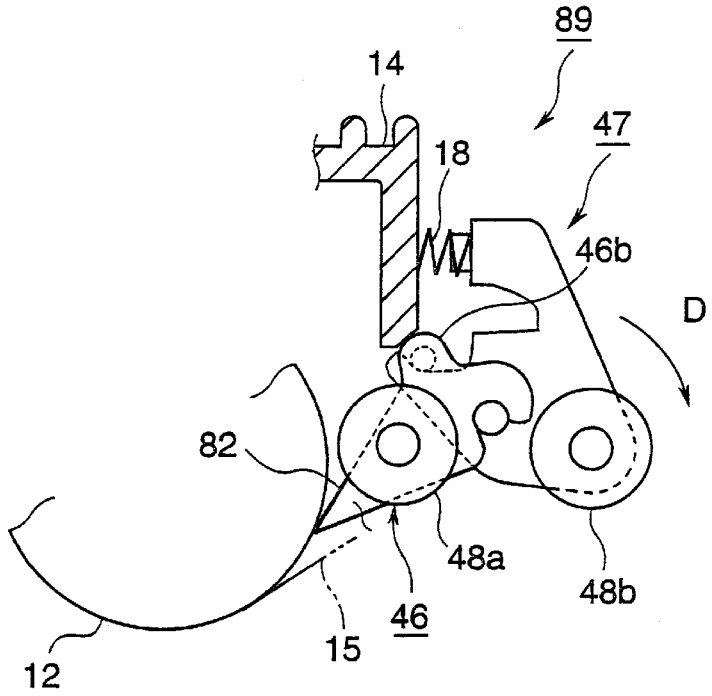
FIG. 12 illustrates the paper-separating mechanism according to the second embodiment when it is in the standby position.

FIG. 12 illustrates the paper-separating mechanism when it is in the standby position.

Figure 13:
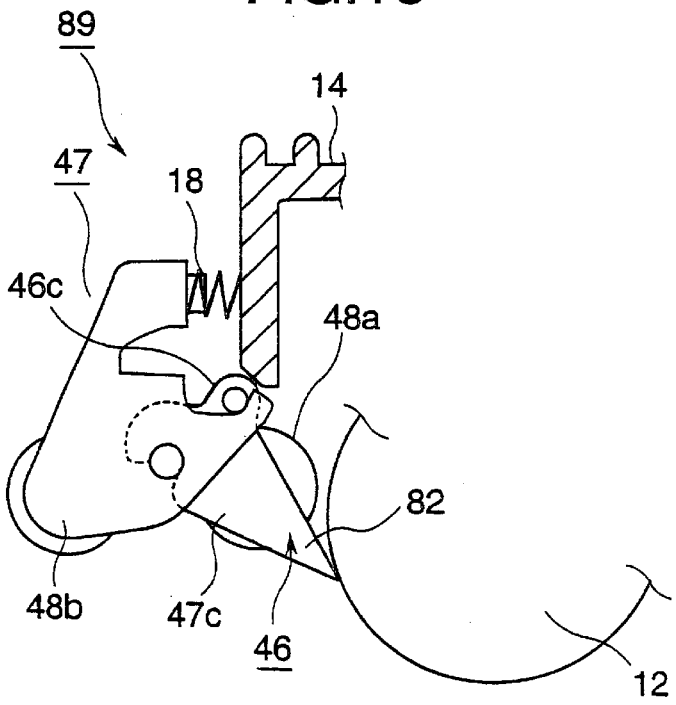
FIG. 13 is a rear view of FIG. 12.

FIG. 13 is a rear view of FIG. 12.

Prior to the arrival of the recording paper 15 at the fixing section, the spring 18 urges the holder 47 to rotate in a direction shown by arrow D so that the pin 46c abuts the stopper 47*c* and the tip 82 is in contact with the heat roller 12. It is to be noted that the stopper portion 46*b* of the lug 46 is not in contact with the casing 14.

Figure 14:
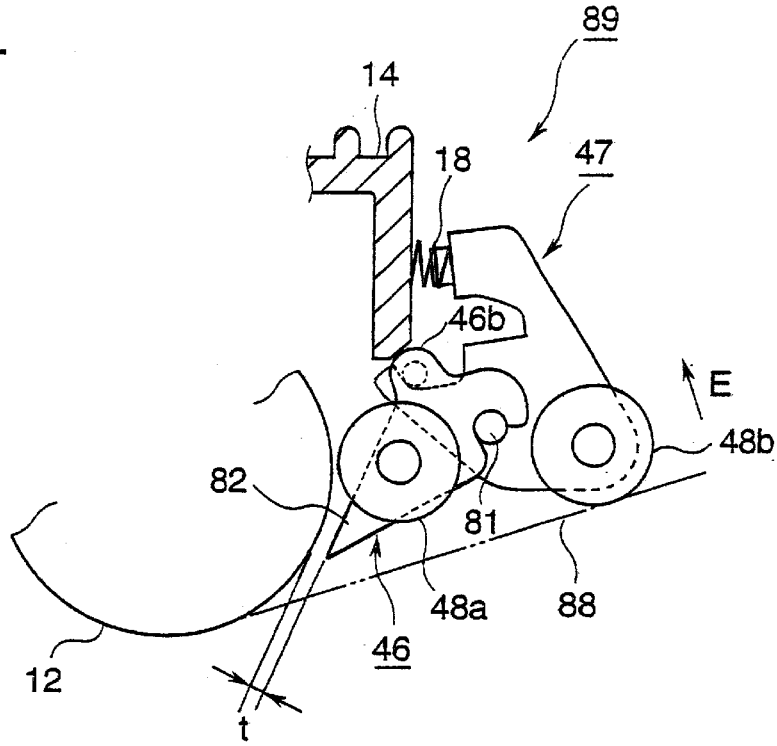
FIG. 14 illustrates the paper separating mechanism according to the second embodiment when the recording paper pushes the guide roller up.

FIG. 14 illustrates the paper separating mechanism 89 when the recording paper 15 pushes up the downstream guide roller 48*b*.

Figure 15:
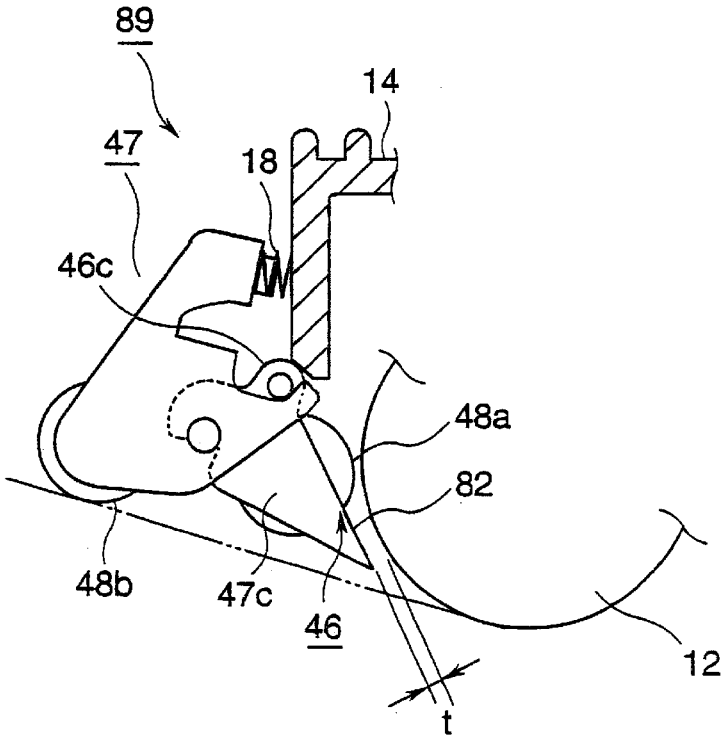
FIG. 15 is a rear view of FIG. 14.

FIG. 15 is a rear view of FIG. 14.

When the leading end of the recording paper 15 comes into contact with the downstream guide roller 48*b*, the recording paper 15 pushes up the downstream guide roller 48*b* in the direction shown by arrow E against the urging force of the spring 18. Thus, the lug 46 rotates about the shaft 81 with the pin 46*c* abutting the stopper 47*c*, so that the tip 82 of the lug 46 leaves the heat roller 12. The tip 82 can be away from the surface of the heat roller 12 by a maximum distance t.

The recording paper 15 is further advanced between the transport roller 19 and the pinch roller 20 of the discharging section toward the paper exit. When the trailing end of the recording paper 15 has passed the downstream guide roller 48*b*, the lug 46 returns to the position shown in FIGS. 12 and 13.

Figure 16:
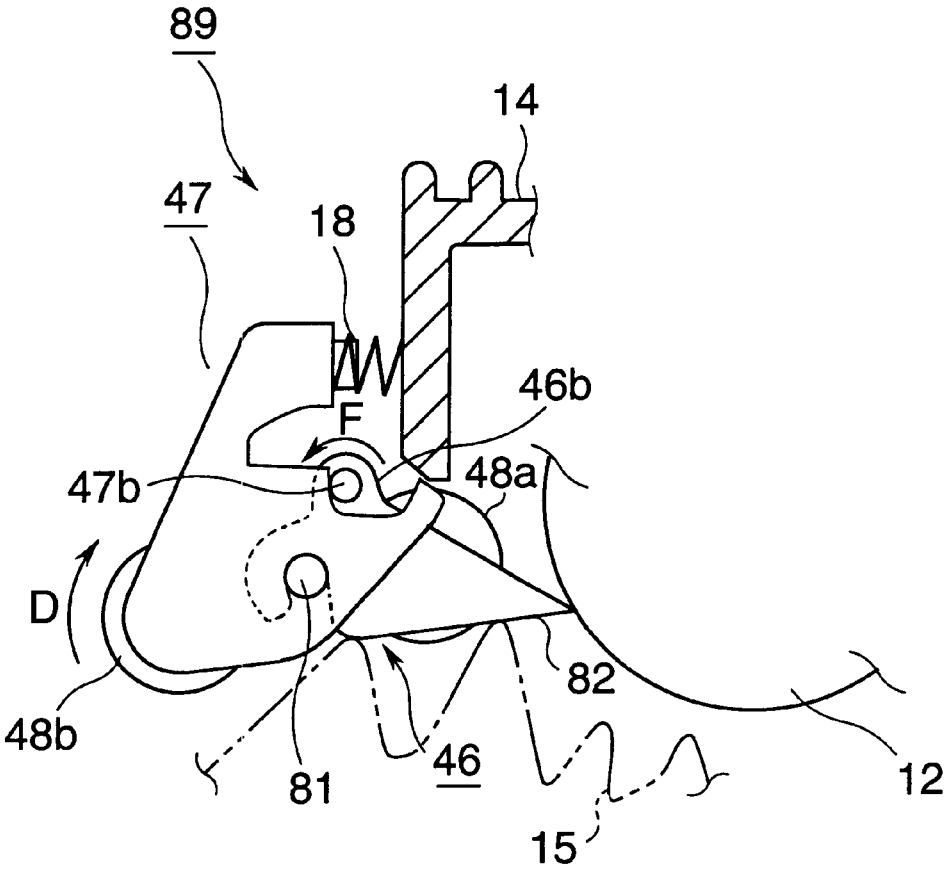
FIG. 16 illustrates a paper jam.

FIG. 16 illustrates a paper jam.

When the recording paper 15 is jammed near the lug 46 and deformed into a bellow shape, the bellow-shaped paper 15 pushes up the tip 82, so that the lug 46 rotates in a direction shown by arrow F till the pin 46*c* abuts the stopper 47*b*. In this manner, the tip 82 prevents the recording paper 15 from entering the gap between the tip 82 and the heat roller 12. Thus, when the user pulls the recording paper 15 from outside in an attempt to remove the jammed paper, the recording paper 15 is not caught between the heat roller 12 and the tip 82.

Figure 17:
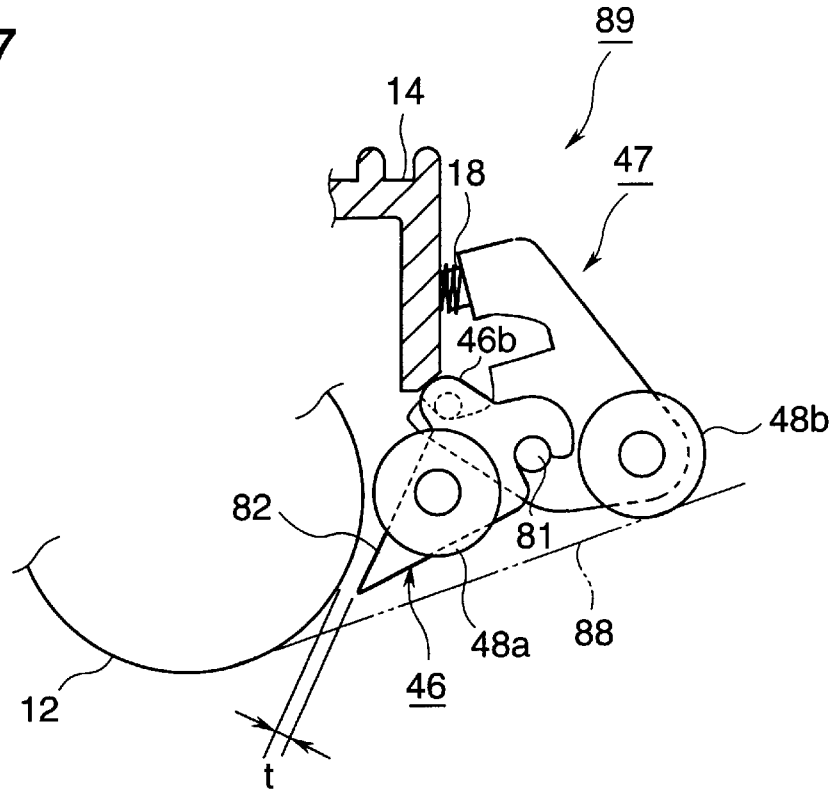
FIG. 17 illustrates the paper separating mechanism of the second embodiment when the relatively thick, stiff recording paper pushes the guide roller up.

FIG. 17 illustrates the paper-separating mechanism 89 when thick, stiff recording paper 88 is fed to the fixing section.

Figure 18:
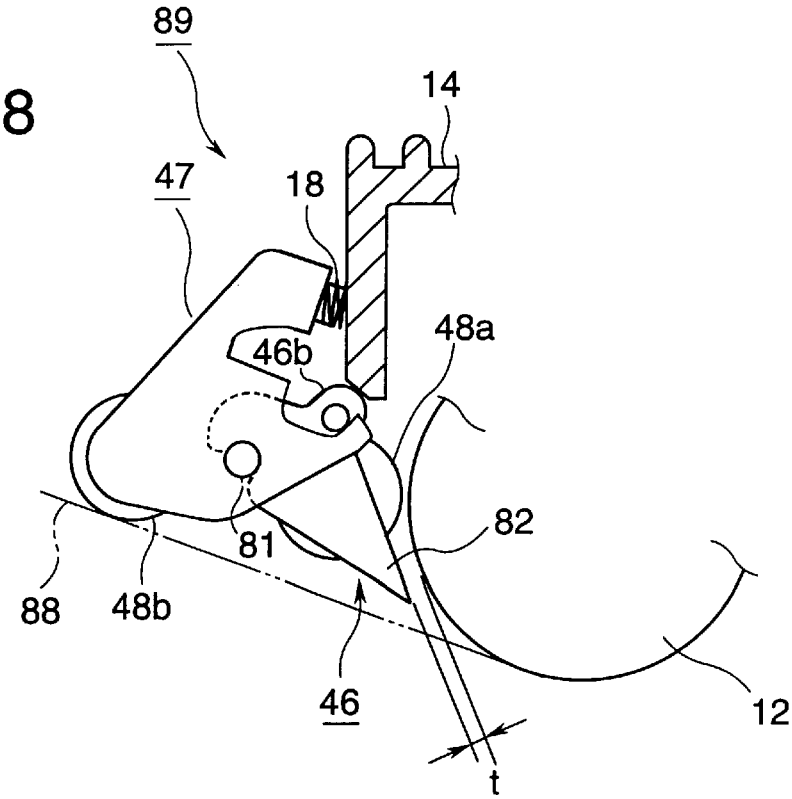
FIG. 18 is a rear view of FIG. 17.
Figure 19:
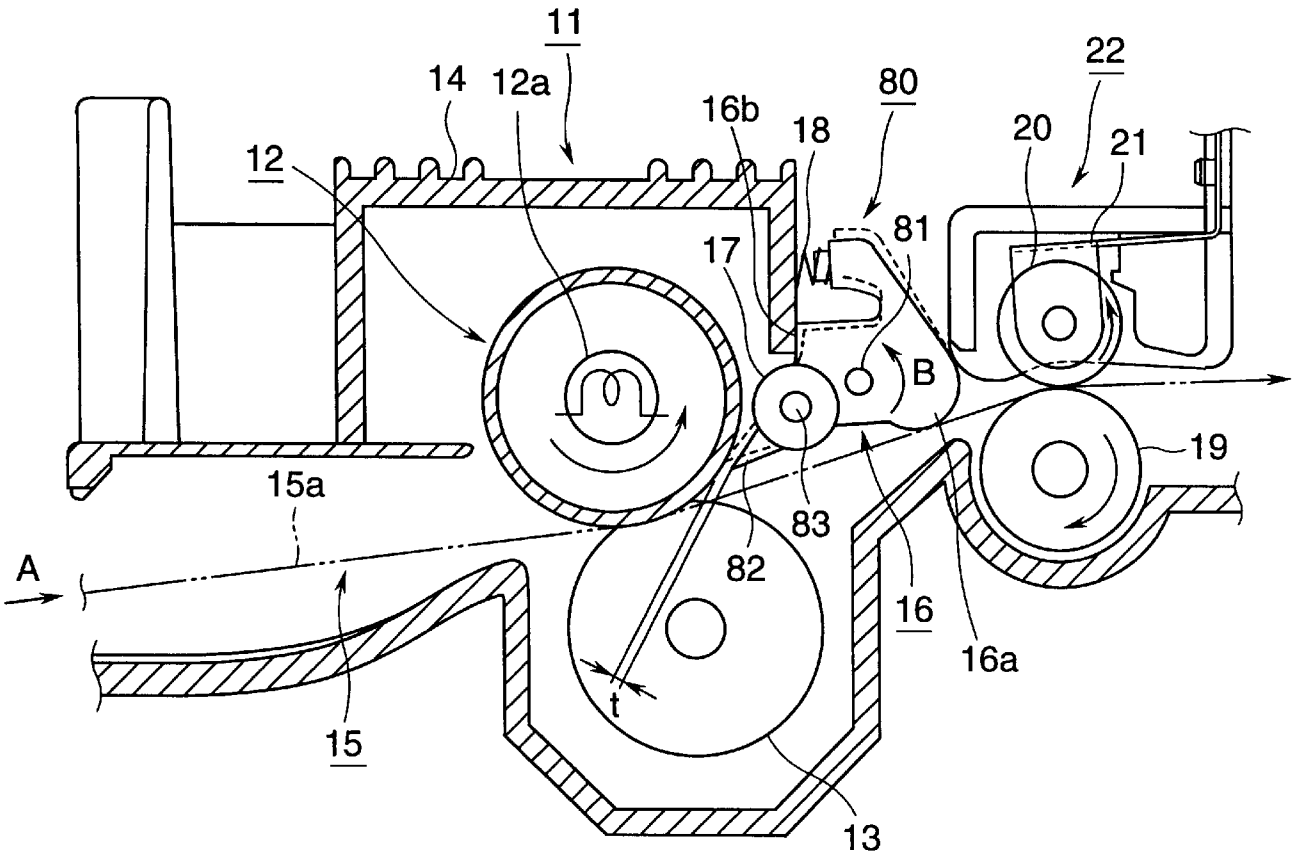
FIG.19 CONVENTIONAL ART
FIG. 19 is a cross-sectional view of a conventional art fixing apparatus.
Figure 20:
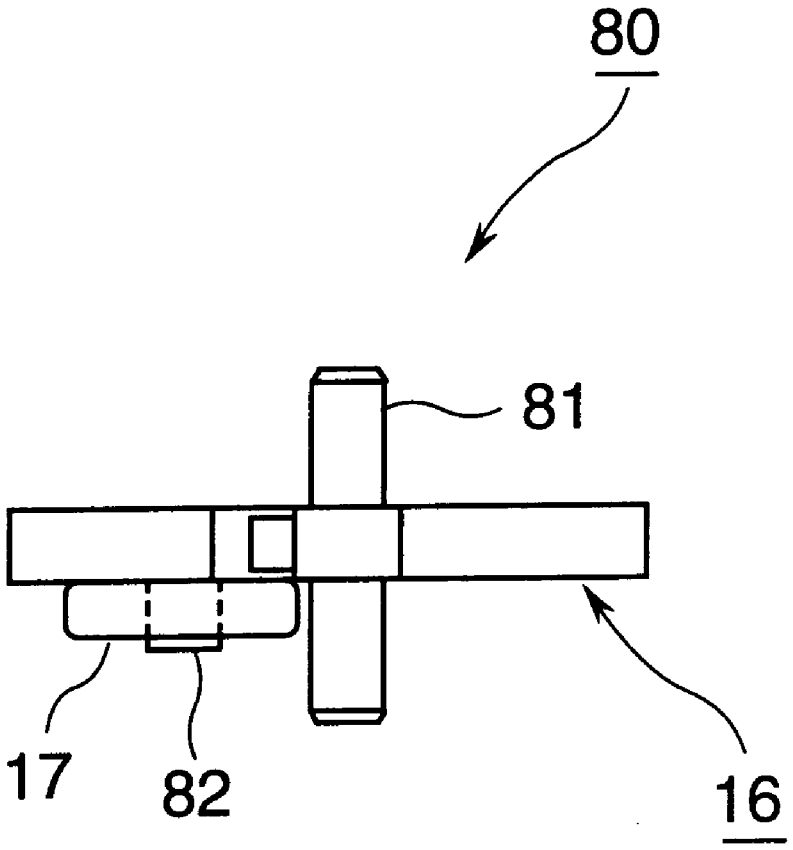
FIG.20 CONVENTIONAL ART
FIG. 20 is a top view illustrating a relevant portion of the conventional art paper-separating apparatus for use in the fixing apparatus.

FIG. 18 is a rear view of FIG. 17.

When the leading end of the recording paper 15 pushes up the downstream guide roller 48*b*, the holder 47 is yieldably rotated against the urging force of the spring 18. It is to be noted that since the recording paper 88 is stiffer than the recording paper 15, a larger force pushes up the second roller 48*b*. Therefore, the spring 18 is more compressed when the stiff paper 88 passes than when soft paper passes.

In the second embodiment, the downstream guide roller 48*b* does not rub the printed surface of the recording paper 15 but simply rotates on the printed surface. Thus, when a solid black image is printed on the recording paper 15, there is no significant difference in gloss between the image areas that are brought into contact with the downstream guide roller 48*b* and the image areas that are not brought into contact with the downstream guide roller. This improves the image quality.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A fixing apparatus comprising:

a first roller; and a lug movable between a first position and a second position, said lug engaging said first roller to separate a recording medium from said first roller, said lug being brought into contact engagement with said first roller when said lug is at the first position and out of contact engagement with the first roller when said lug is at the second position, wherein when said lug is at the second position and the recording medium pushes the lug, said lug moves to the first position.

2. A fixing apparatus comprising:

a first roller;

a lug assembly movable between a first position and a second position, said lug assembly engaging said first roller to separate a recording medium from said first roller, wherein said lug assembly has a lug with a tip, and a holder that supports said lug such that said lug is rotatable relative to said holder, wherein when said lug assembly is at the first position and a recording medium pushes said holder to move, the lug operatively moves so that the tip moves out of contact engagement with said first roller, and wherein when said lug assembly is at the second position and the recording medium pushes said lug to move, said lug rotates relative to said holder such that the tip moves toward said first roller.

3. The fixing apparatus according to claim 2, further comprising a second roller mounted on said holder such that the second roller is rotatable relative to said holder.

4. A fixing apparatus comprising:

a first roller;

a lug movable between a first position and a second position, spaced from the first position by a predetermined distance, said lug being brought into contact engagement with the first roller when said lug is at the first position, and out of contact engagement with the first roller when the lug is at the second position;

a second roller mounted on said lug and movable to different positions relative to said lug; and an urging member that urges said second roller toward a plane of a travel path of a recording medium wherein when said lug is at the second position and the recording medium pushes said second roller, said second roller moves relative to said lug in a direction away from the plane.

5. The fixing apparatus according to claim 4, further comprising a stopper that abuts said lug to stop said lug at the second position wherein said second roller moves relative to said lug against an urging force of said urging member after said lug has stopped at the second position.

* * * * *